US007370648B1

(12) United States Patent
Ventimiglia, Jr.

(10) Patent No.: US 7,370,648 B1
(45) Date of Patent: May 13, 2008

(54) WATER HEATER SYSTEM

(76) Inventor: Philip J. Ventimiglia, Jr., 10912 Covey Ct., Tampa, FL (US) 33625

( * ) Notice: Subject to any disclaimer, the term of this patent is extended or adjusted under 35 U.S.C. 154(b) by 295 days.

(21) Appl. No.: 11/210,491

(22) Filed: Aug. 24, 2005

(51) Int. Cl.
*F24H 1/00* (2006.01)

(52) U.S. Cl. ..... 126/376.1; 362/126; 362/92; 122/13.01

(58) Field of Classification Search ..... 362/126, 362/92; 122/13.01, 18.5, 19.2, 592.22; 220/694.1; 126/376.1, 390.1
See application file for complete search history.

(56) References Cited

U.S. PATENT DOCUMENTS 2,327,200 A * 8/1943 Lotter ..... 362/94
3,457,095 A * 7/1969 Doering et al. ..... 427/161
4,805,662 A * 2/1989 Moody ..... 137/312
5,474,202 A * 12/1995 Moore, Jr. ..... 220/567.3
5,855,747 A * 1/1999 Lusk ..... 204/196.19
6,029,615 A * 2/2000 Terwilliger et al. ..... 122/494
6,547,558 B2 * 4/2003 McCall ..... 432/250
6,554,610 B2 * 4/2003 McCall ..... 432/250
6,698,386 B1 * 3/2004 Hoffman ..... 122/14.31
2001/0032475 A1 * 10/2001 Chen et al. ..... 62/238.7
2002/0189554 A1 * 12/2002 Kohler et al. ..... 122/13.01

* cited by examiner

*Primary Examiner*—Terrence R. Till
*Assistant Examiner*—Andrew St. Clair
(74) *Attorney, Agent, or Firm*—Edward P Dutkiewicz

(57) ABSTRACT

A housing has a top, a bottom and side walls. A liner has a top, a bottom, and side walls. The liner is fabricated of glass. A space is provided between the liner and housing. Insulation material is provided throughout the space. A heating assembly is provided within the liner. Glass water inlet and outlet lines extend through the housing and liner.

1 Claim, 3 Drawing Sheets

FIG 3
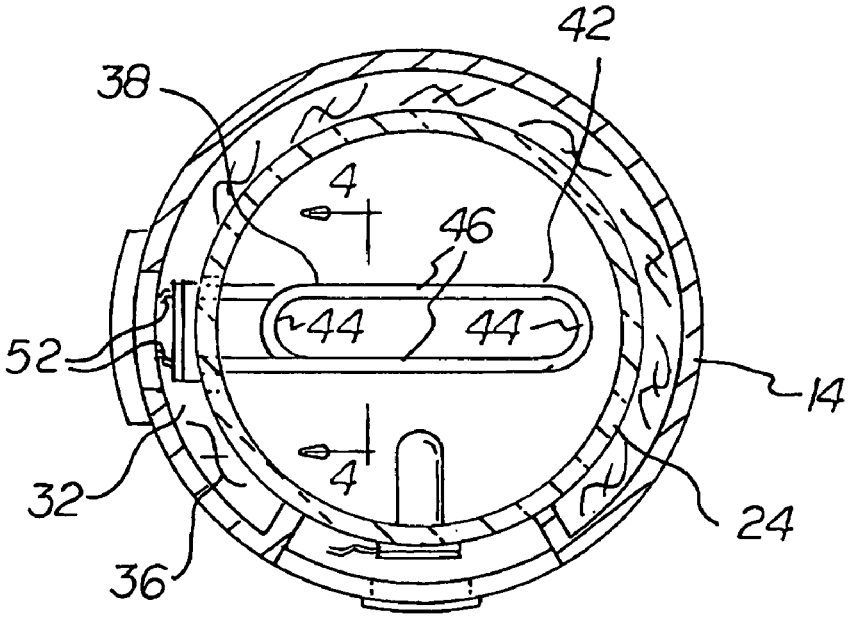
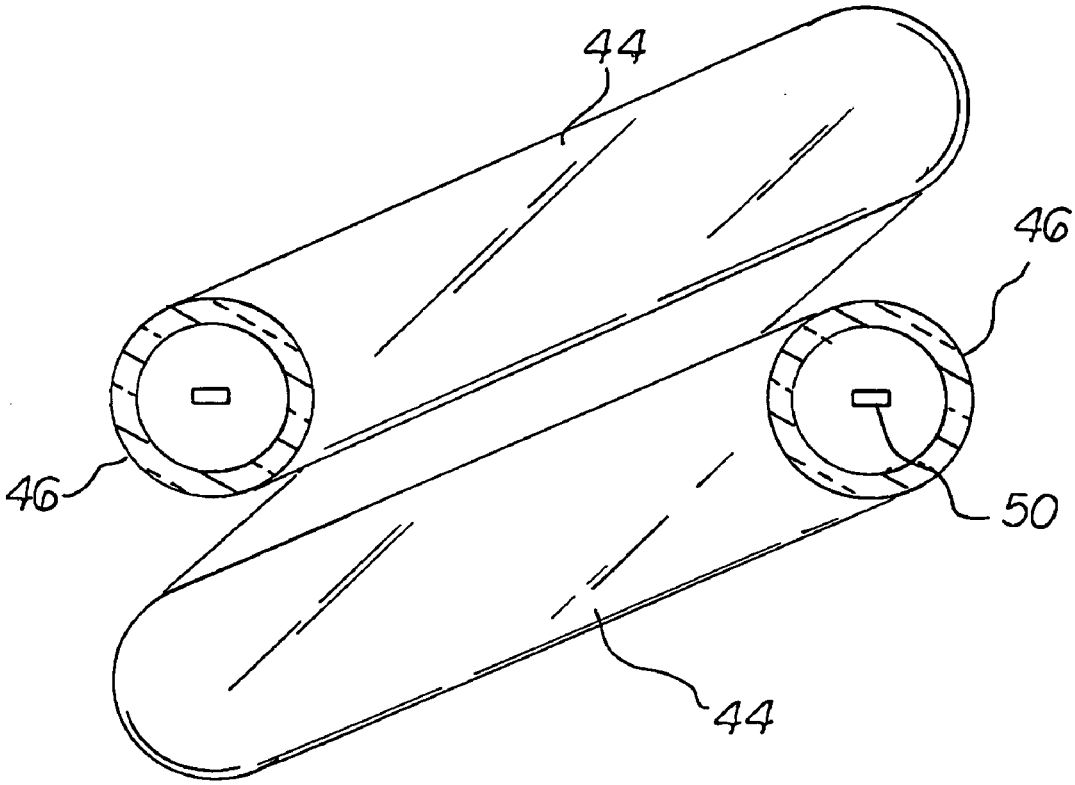
FIG 4

WATER HEATER SYSTEM

BACKGROUND OF THE INVENTION

1. Field of the Invention

The present invention relates to a water heater system and more particularly pertains to abating contamination of water in the system to be heated.

2. Description of the Prior Art

The use of leak detection systems of known designs and configurations is known in the prior art. More specifically, leak detection systems of known designs and configurations previously devised and utilized for the purpose of detecting leaks through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,526,807 issued Mar. 4, 2003 to Doumit relates to an Early Warning Water Leak Detection System. U.S. Pat. No. 6,147,613 issued Nov. 14, 2000 to Doumit relates to an Early Warning Water Leak Detection System. Lastly, U.S. Pat. No. 5,545,878 issued Aug. 13, 1996 to Jasper relates to a Defrost Heater With Spiral Vent.

While these devices fulfill their respective, particular objectives and requirements, the aforementioned patents do not describe a water heater system that allows abating contamination of water in the system to be heated.

In this respect, the water heater system according to the present invention substantially departs from the conventional concepts and designs of the prior art, and in doing so provides an apparatus primarily developed for the purpose of abating contamination of water in the system to be heated.

Therefore, it can be appreciated that there exists a continuing need for a new and improved water heater system which can be used for abating contamination of water in the system to be heated. In this regard, the present invention substantially fulfills this need.

SUMMARY OF THE INVENTION

In view of the foregoing disadvantages inherent in the known types of leak detection systems of known designs and configurations now present in the prior art, the present invention provides an improved water heater system. As such, the general purpose of the present invention, which will be described subsequently in greater detail, is to provide a new and improved water heater system and method which has all the advantages of the prior art and none of the disadvantages.

To attain this, the present invention essentially comprises a water heater system. First provided is a housing. The housing has a circular top. The housing has a circular bottom. The housing has a cylindrical side wall. The sidewall is provided between the top and the bottom. The housing is fabricated of a metallic material.

A liner is provided. The liner has a circular top. The liner has a circular bottom. The liner has a cylindrical side wall. The side wall is provided between the top and the bottom. The liner is fabricated of a unitary piece of glass. The top and bottom and side wall of the liner all are smaller than the top and bottom and side wall of the housing. In this manner a space is formed above and below and around the sides of the liner and within the housing.

Insulation material is provided. The insulation material is provided throughout the space above and below and around the sides of the liner and within the housing.

Provided next is a pair of heating assemblies. The heating assemblies are provided within the liner. The heating assemblies include an upper heating assembly. The upper heating assembly is in proximity to a central elevational height of the liner. The heating assemblies include a lower heating assembly. The lower heating assembly is proximity to the bottom of the liner. Each heating assembly includes a hollow glass tube. The glass tube has a circular cross sectional configuration. The heating assembly is formed into oval portions. The oval portions have curved extents. The curved extents are in proximity to the liner. The oval portions have linear extents. The linear extents are coupled to the curved extent. The linear extents extends through the liner. An electrically conductive heating element is provided. The heating element is provided within each glass tube. The heating element is positioned out of contact with the glass tube. Electrical leads are provided. The electrical leads are in contact with the heating elements. The electrical leads extend into the space for coupling the heating elements to a source of potential for heating water within the liner.

A water inlet line is provided. The water inlet line is fabricated of glass. The water inlet line extends from exterior of the housing and liner through the top of the housing and liner. The water inlet line terminates with an outlet at a location within the liner at an elevational height above the upper heater assembly. The water inlet line has an L-shaped bend. The bend is exterior of and above the housing. A protective shield is provided over the bend. The water inlet line also has an in-line water filter. The in-line water filter is provided in advance of the bend.

A water outlet line is provided. The water outlet line is fabricated of glass. The water outlet line extends to exterior of the housing and liner through the top of the housing and liner with an inlet at a location within the liner at an elevational height in proximity to the bottom of the liner. The water inlet line has an L-shaped bend. The bend is exterior of and above the housing. A protective shield is provided over the bend.

Provided next is a viewing zone. The viewing zone is formed as a rectangular opening in the housing. The central elevational height of the viewing zone is at the elevational height of the upper heater assembly. The upper elevational height of the viewing zone is at the elevational height of the outlet of the water input line. The viewing area is located to allow an observer to observe the upper heating assembly and the outlet end of the water input line.

A light is provided. The light includes a bulb. The bulb includes an illumination filament. The bulb includes an enclosing glass cover. The glass cover is secured within the liner. The elevational height of the glass bulb is between the viewing zone and the lower heating assembly for illuminating the interior of the liner. The housing is formed with an opening. The opening is adjacent to the bulb. The opening has a removable cover for repair and replacement of the bulb.

A pair of thermostats is provided next. The pair of thermostats is provided on the housing. Each thermostat is located in proximity to an associated heating assembly. Each thermostat is operatively coupled to the heating assembly. In this manner the temperature of water within the liner is sensed and controlled.

Further provided is an overflow valve. The overflow valve is provided on the top of the housing. In this manner pressure is relieved in the event of over heating.

A float level switch is provided in the water inlet line. Such switch functions to allow the adding of water to the liner as needed.

Provided last is a faucet. The faucet extends through the sidewalls of the housing and liner. The faucet is provided adjacent to the bottoms thereof for emptying the tank.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water heater system which has all of the advantages of the prior art leak detection systems of known designs and configurations and none of the disadvantages.

It is another object of the present invention to provide a new and improved water heater system which may be easily and efficiently manufactured and marketed.

It is further object of the present invention to provide a new and improved water heater system which is of durable and reliable constructions.

An even further object of the present invention is to provide a new and improved water heater system which is susceptible of a low cost of manufacture with regard to both its materials and its labor, and which accordingly is then susceptible of low prices of sale to the consuming public, thereby making such water heater system economically available to the buying public.

Even still another object of the present invention is to provide a water heater system for abating contamination of water in the system to be heated.

Lastly, it is an object of the present invention to provide a new and improved water heater system. A housing has a top, a bottom and side walls. A liner has a top, a bottom, and side walls. The liner is fabricated of glass. A space is provided between the liner and housing. Insulation material is provided throughout the space. A heating assembly is provided within the liner. Glass water inlet and outlet lines extend through the housing and liner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated herein the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a water heater system constructed in accordance with the principles of the present invention.

FIG. 3 is a cross sectional view of the system taken along line 3-3 of FIG. 1.

FIG. 4 is an enlarged cross sectional view of the system taken along line-4 of FIG. 3.

The same reference numerals refer to the same parts throughout the various Figures.

DESCRIPTION OF THE PREFERRED EMBODIMENT

Figure 2:
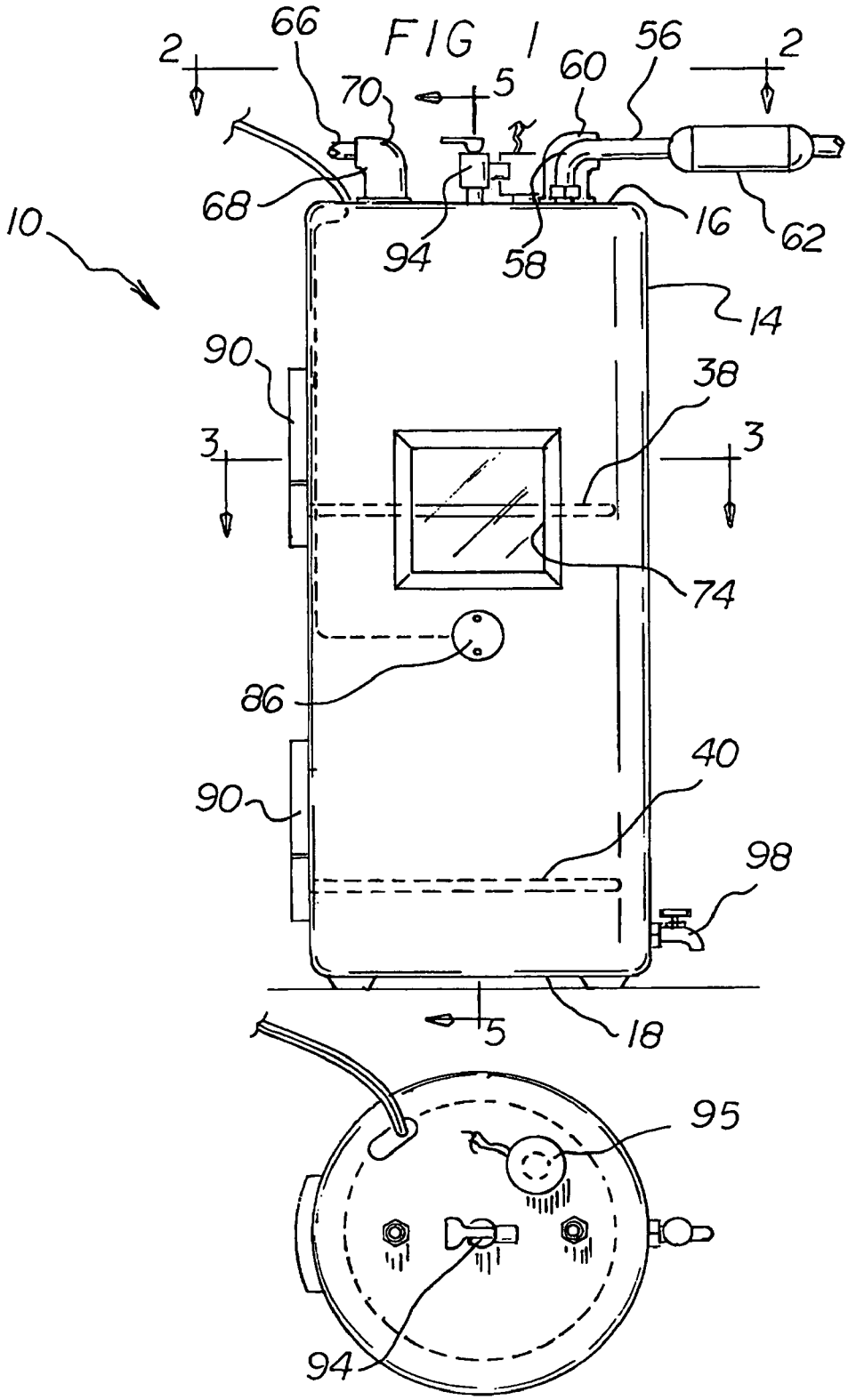
FIG. 2 is a plan view of the system taken along line 2-2 of FIG. 1.
Figure 5:
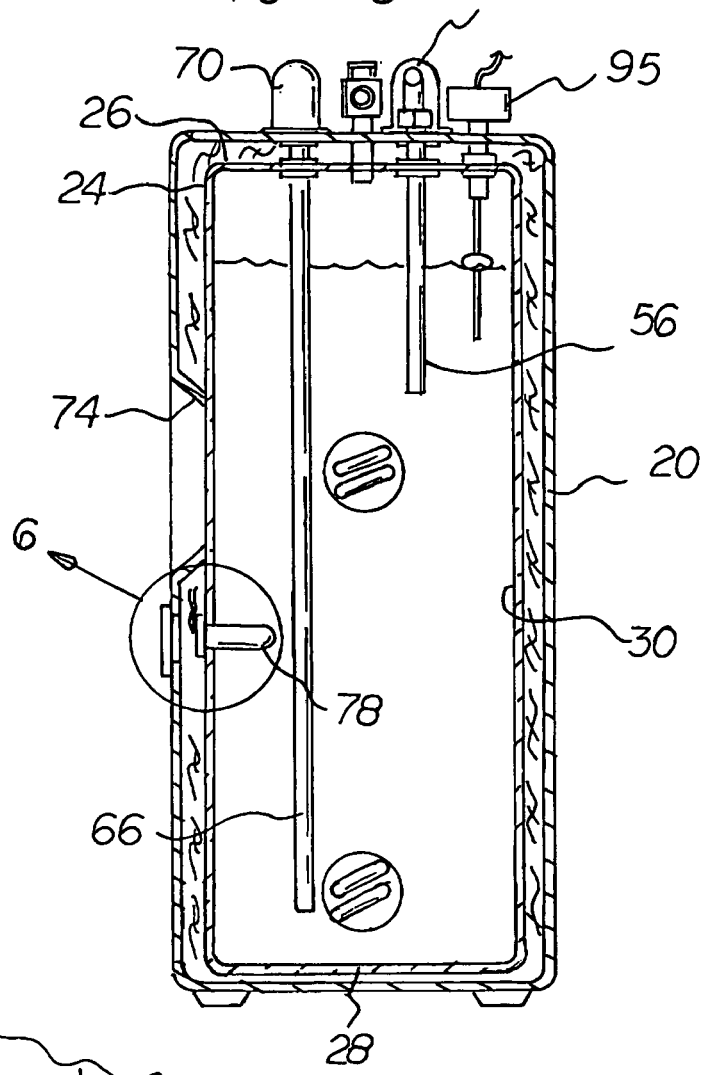
FIG. 5 is a cross sectional view of the system taken along line 5-5 of FIG. 1.
Figure 6:
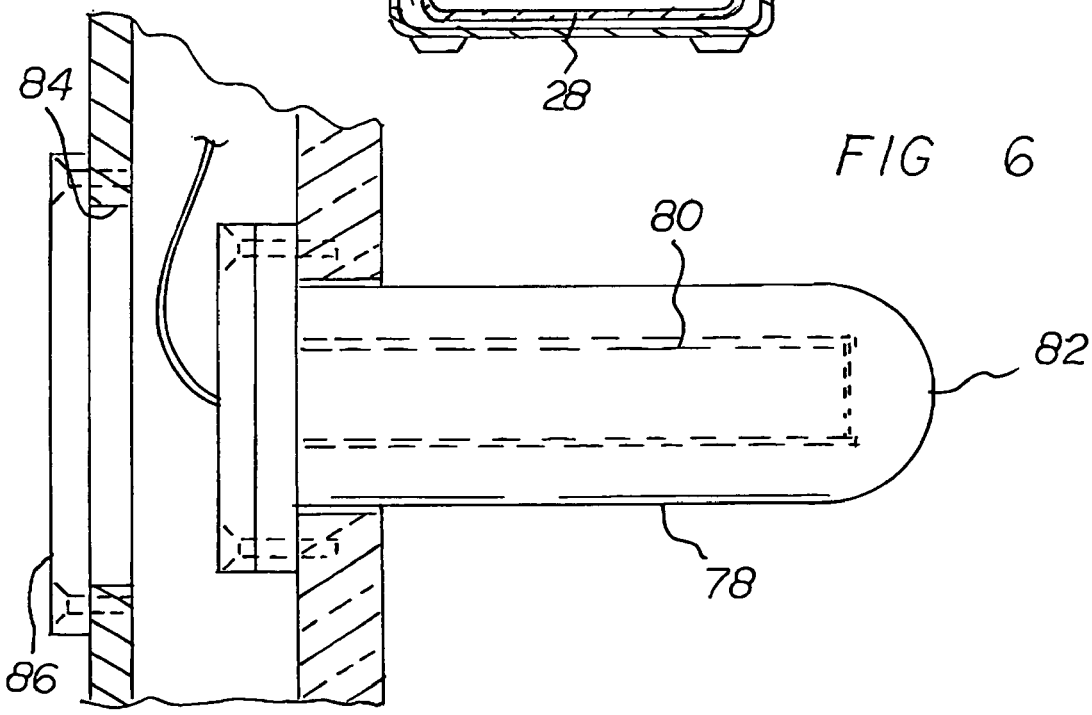
FIG. 6 is an enlarged cross sectional showing taken at circle 6 of FIG. 5.

With reference now to the drawings, and in particular to FIG. 1 thereof, the preferred embodiment of the new and improved water heater system embodying the principles and concepts of the present invention and generally designated by the reference numeral 10 will be described.

The present invention, the water heater system 10 is comprised of a plurality of components. Such components in their broadest context include a housing, a liner, insulation material, and glass water inlet and outlet lines. Such components are individually configured and correlated with respect to each other so as to attain the desired objective.

First provided is a housing 14. The housing has a circular top 16. The housing has a circular bottom 18. The housing has a cylindrical side wall 20. The sidewall is provided between the top and the bottom. The housing is fabricated of a metallic material.

A liner 24 is provided. The liner has a circular top 26. The linear has a circular bottom 28. The liner has a cylindrical side wall 30. The side wall is provided between the top and the bottom. The liner is fabricated of a unitary piece of glass. The top and bottom and side wall of the liner all are smaller than the top and bottom and side wall of the housing. In this manner a space 32 is formed above and below and around the sides of the liner and within the housing.

Insulation material 36 is provided. The insulation material is provided throughout the space above and below and around the sides of the liner and within the housing. The insulation material is selected from the class of thermally insulating materials which includes fibers and foam and blends thereof.

Provided next is a pair of heating assemblies 38, 40. The heating assemblies are provided within the liner. The heating assemblies include an upper heating assembly 38. The upper heating assembly is in proximity to a central elevational height of the liner. The heating assemblies include a lower heating assembly 40. The lower heating assembly is proximity to the bottom of the liner. Each heating assembly includes a hollow glass tube. The glass tube has a circular cross sectional configuration. The heating assembly is formed into oval portions 42. The oval portions have curved extents 44. The curved extents are in proximity to the liner. The oval portions have linear extents 46. The linear extents are coupled to the curved extent. The linear extents extends through the liner. An electrically conductive heating element 50 is provided. The heating element is provided within each glass tube. The heating element is positioned out of contact with the glass tube. Electrical leads 52 are provided. The electrical leads are in contact with the heating elements. The electrical leads extend into the space for coupling the heating elements to a source of potential for heating water within the liner.

A water inlet line 56 is provided. The water inlet line is fabricated of glass. The water inlet line extends from exterior of the housing and liner through the top of the housing and liner. The water inlet line terminates with an outlet at a location within the liner at an elevational height above the upper heater assembly. The water inlet line has an L-shaped bend 58. The bend is exterior of and above the housing. A protective shield 60 is provided over the bend. The water inlet line also has an in-line water filter 62. The in-line water filter is provided in advance of the bend.

A water outlet line 66 is provided. The water outlet line is fabricated of glass. The water outlet line extends to exterior of the housing and liner through the top of the housing and liner with an inlet at a location within the liner at an elevational height in proximity to the bottom of the liner. The water inlet line has an L-shaped bend 68. The bend is exterior of and above the housing. A protective shield 70 is provided over the bend.

Provided next is a viewing zone 74. The viewing zone is formed as a rectangular opening in the housing. The central elevational height of the viewing zone is at the elevational height of the upper heater assembly. The upper elevational height of the viewing zone is at the elevational height of the outlet of the water input line. The viewing area is located to allow an observer to observe the upper heating assembly and the outlet end of the water input line. The viewing zone has a preferred height of between about 15 and 20 percent of the height of the housing and a width of between 20 and 25 percent of the circumference of the housing.

A light is provided. The light includes a bulb 78. The bulb includes an illumination filament 80. The bulb includes an enclosing glass cover 82. The glass cover is secured within the liner. The elevational height of the glass bulb is between the viewing zone and the lower heating assembly for illuminating the interior of the liner. The housing is formed with an opening 84. The opening is adjacent to the bulb. The opening has a removable cover 86 for repair and replacement of the bulb.

A pair of thermostats 90 is provided next. The pair of thermostats is provided on the housing. Each thermostat is located in proximity to an associated heating assembly. Each thermostat is operatively coupled to the heating assembly. In this manner the temperature of water within the liner is sensed and controlled.

Further provided is an overflow valve 94. The overflow valve is provided on the top of the housing. In this manner pressure is relieved in the event of over heating.

A float level switch 95 is provided in the water inlet line. Such switch functions to allow the adding of water to the liner as needed.

Provided last is a faucet 98. The faucet extends through the sidewalls of the housing and liner. The faucet is provided adjacent to the bottoms thereof for emptying the tank.

The faucet is preferably operatively coupled with the thermostats and water lines so as to drain the liner in the event of an adverse circumstance such as a freezing temperature or a power interruption. Such draining would preclude liner breakage. The operative coupling also preferably allows for the refilling of the tank after the return of power and temperatures above freezing.

The system of the present invention is adapted for heating water as for use in houses and other buildings where contaminated water would constitute a health hazard. Such system is also adapted for other applications such as swimming pools and the like where contaminated water would stain and ruin surfaces brought in contact there with.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water heater system featuring a metallic housing with a glass liner for abating contamination of water in the system to be heated comprising, in combination:

a housing having a circular top and a circular bottom with a cylindrical side wall there between, the housing being fabricated of a metallic material;

a liner having a circular top and a circular bottom with a cylindrical side wall there between, the liner being fabricated of a unitary piece of glass, the top and bottom and side wall of the liner all being smaller than the top and bottom and side wall of the housing thereby forming a space above and below and around the sides of the liner and within the housing;

insulation material throughout the space above and below and around the sides of the liner and within the housing;

a pair of heating assemblies within the liner including an upper heating assembly in proximity to a central elevational height of the liner and a lower heating assembly in proximity to the bottom of the liner, each heating assembly including a hollow glass tube with a circular cross sectional configuration and formed into oval portions with curved extents in proximity to the liner and with linear extents coupling the curved extent and extending through the liner, an electrically conductive heating element within each glass tube positioned out of contact with the glass tube, electrical leads in contact with the heating elements and extending into the space for coupling the heating elements to a source of potential for heating water within the liner;

a water inlet line fabricated of glass extending from exterior of the housing and liner through the top of the housing and liner terminating with an outlet at a location within the liner at an elevational height above the upper heater assembly, the water inlet line having an L-shaped bend exterior of and above the housing with a protective shield over the bend, the water inlet line also having an in-line water filter in advance of the bend;

a water outlet line fabricated of glass extending to exterior of the housing and liner through the top of the housing and liner with an inlet at a location within the liner at an elevational height in proximity to the bottom of the liner, the water inlet line having an L-shaped bend exterior of and above the housing with a protective shield over the bend;

a viewing zone formed as a rectangular opening in the housing with a central elevational height of the viewing zone at the elevational height of the upper heater assembly and the upper elevational height of the viewing zone at the elevational height of the outlet of the water input line, the viewing area thus being located to allow an observer to observe the upper heating assembly and the outlet end of the water input line;

a light including a bulb with an illumination filament and an enclosing glass cover secured within the liner at an elevational height between the viewing zone and the lower heating assembly for illuminating the interior of the liner, the housing being formed with an opening adjacent to the bulb with a removable cover for repair and replacement of the bulb;

a pair of thermostats on the housing, each thermostat located in proximity to an associated heating assembly and operatively coupled thereto for sensing and controlling the temperature of water within the liner;

an overflow valve on the top of the housing for the relief of pressure in the event of over heating;

a float level switch in the water inlet line to allow the adding of water to the liner as needed; and a faucet extending through the sidewalls of the housing and liner adjacent to the bottoms thereof for emptying the tank.

* * * * *